US007637131B2

(12) United States Patent
Amir

(10) Patent No.: US 7,637,131 B2
(45) Date of Patent: Dec. 29, 2009

(54) ELECTRONIC CYLINDER INTERNAL KEY APPARATUS AND METHOD

(75) Inventor: Haim Amir, Ramat Hasharon (IL)

(73) Assignee: Essence Security International Ltd., Herzliya (IL)

( * ) Notice: Subject to any disclaimer, the term of this patent is extended or adjusted under 35 U.S.C. 154(b) by 210 days.

(21) Appl. No.: 11/469,866

(22) Filed: Sep. 3, 2006

(65) Prior Publication Data

US 2008/0053175 A1 Mar. 6, 2008

(51) Int. Cl.
*E05B 47/00* (2006.01)

(52) U.S. Cl. ..... 70/277; 70/278.3; 70/278.7; 70/279.1; 70/283.1; 70/337; 70/375; 70/379 R; 70/493; 70/DIG. 60

(58) Field of Classification Search ..... 70/277, 70/278.2, 278.3, 278.7, 279.1, 283.1, DIG. 60, 70/337, 339, 429, 430, DIG. 14, DIG. 63, 70/409, 493, 373, 375, 379 R, 379 A, 380, 70/427, 428, 397, 398, 400, 401, 406
See application file for complete search history.

(56) References Cited

U.S. PATENT DOCUMENTS

| | | | | | |
|---|---|---|---|---|---|
| 1,393,006 | A * | 10/1921 | Block | 70/127 |
| 1,409,094 | A * | 3/1922 | Greenison | 70/134 |
| 2,525,344 | A * | 10/1950 | Garniss | 70/492 |
| 2,544,305 | A * | 3/1951 | Finke et al. | 70/265 |
| 3,267,707 | A * | 8/1966 | Adams | 70/419 |
| 3,479,850 | A * | 11/1969 | Frye | 70/447 |
| 3,680,337 | A * | 8/1972 | Krakauer | 70/419 |
| 3,824,818 | A * | 7/1974 | Neale | 70/358 |
| 3,889,501 | A | 6/1975 | Fort | |
| 4,328,693 | A * | 5/1982 | Lipschutz | 70/431 |
| 4,426,864 | A * | 1/1984 | Morikawa | 70/431 |
| 4,745,785 | A * | 5/1988 | Uebersax | 70/279.1 |
| 4,875,352 | A * | 10/1989 | Smallegan et al. | 70/395 |
| 5,018,375 | A * | 5/1991 | Tully | 70/472 |
| 5,623,844 | A * | 4/1997 | Draeger | 70/408 |
| 5,666,835 | A * | 9/1997 | Keller | 70/397 |
| 5,839,305 | A | 11/1998 | Aston | |
| 5,956,984 | A * | 9/1999 | Hughes | 70/394 |
| 6,125,673 | A * | 10/2000 | Luker | 70/276 |
| 6,532,781 | B1 * | 3/2003 | Keller | 70/358 |
| 7,296,447 | B2 * | 11/2007 | Priest et al. | 70/208 |

* cited by examiner

*Primary Examiner*—Lloyd A Gall
(74) *Attorney, Agent, or Firm*—Mark M. Friedman

(57) ABSTRACT

A cylinder lock device including: a body housing having a bore having a first end and a second end, with a direction of elongation defining an axial direction for the device; a rotatable cylindrical plug in the bore, the plug having an axially extending key slot from the first end; a plurality of tumbler pins deployed at least partially within the plug and displaceable by a key to enable rotation of the plug; and an opening mechanism comprising a shaft connected to a key emulator and wherein the key emulator is translatable into the key slot from within the body housing, the key emulator shaped to match and engage the plurality of tumbler pins, and adapted to displace the plurality of tumbler pins, thereby selectively enabling rotation of the plug.

9 Claims, 7 Drawing Sheets

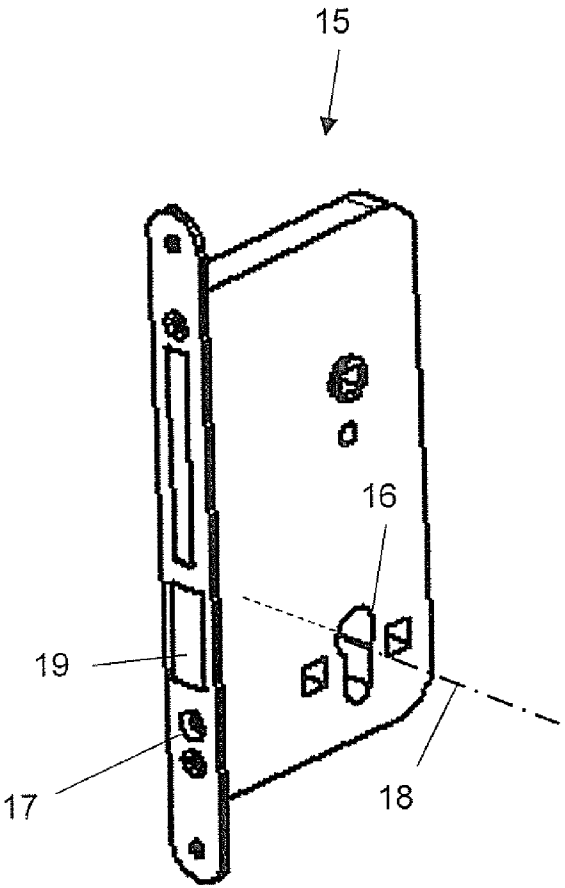
FIG. 1B – PRIOR ART
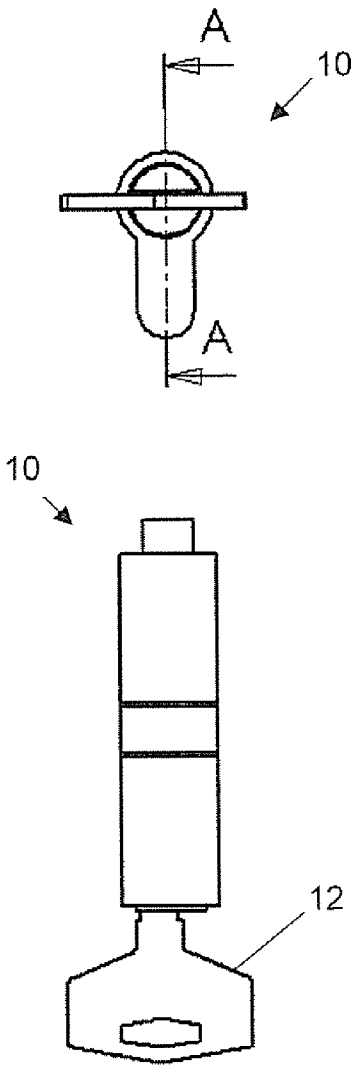
FIG. 1A – PRIOR ART

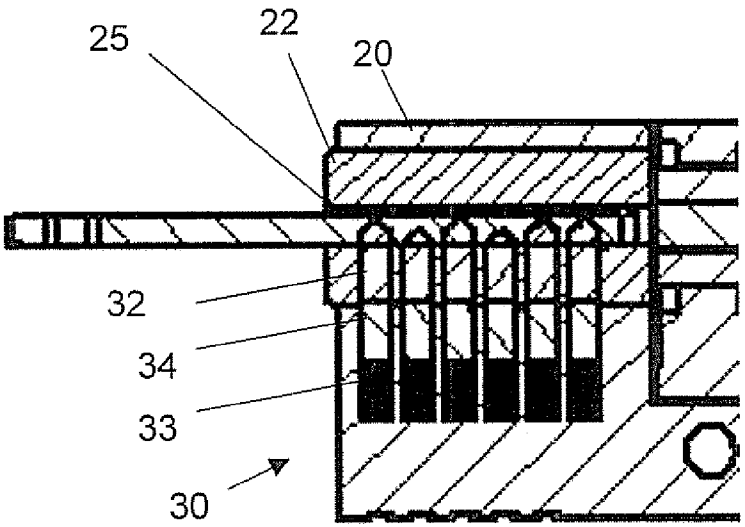
FIG. 2B – PRIOR ART
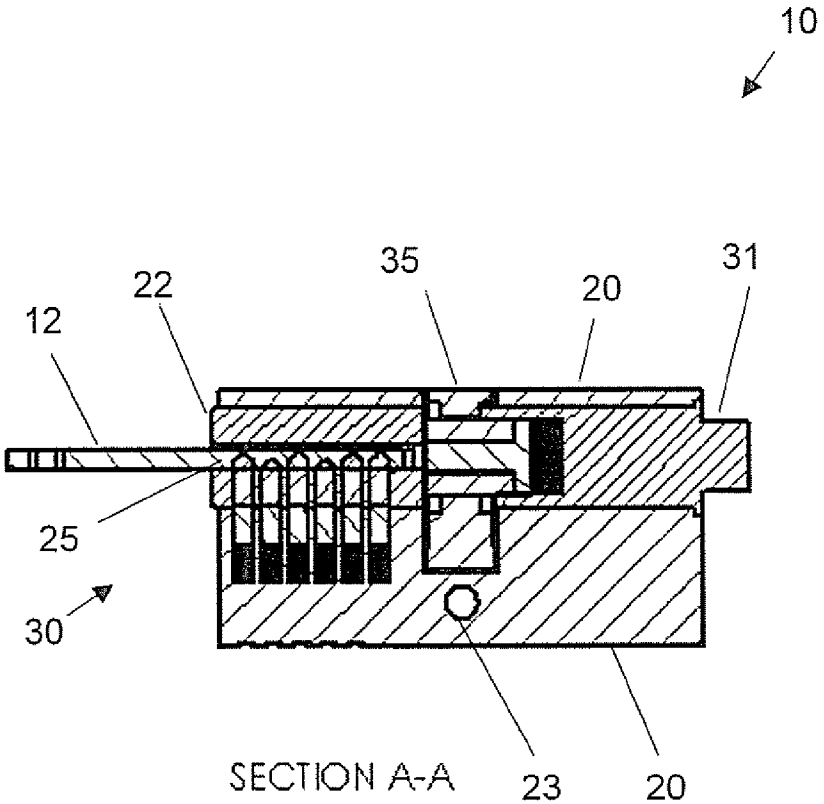
FIG. 2A – PRIOR ART 100
35
110
20
22
23
109
SECTION M-M
SECTION L-L 105
107
108
B
25
L
M
112
200
Section B-B

200
D
35

200
D
E
35

12
E
SECTION D-D

SECTION E-E 200
225
260
255
35
245
240
220
215
205
210
235

ELECTRONIC CYLINDER INTERNAL KEY APPARATUS AND METHOD

FIELD AND BACKGROUND OF THE INVENTION

The present invention relates to cylinder locks and, in particular, it concerns a cylinder look apparatus that can be operated with or without a key.

In a conventional mechanical cylinder lock, when an appropriate matching key is inserted into the cylinder lock, the key serves to mechanically align tumbler pins, thereby allowing the cylindrical plug to be rotated freely to open the lock. Reference is now made to FIGS. 1A and 1B, which are representations of a prior art cylinder lock 10, with a key 12 inserted into the cylinder lock, and a door lock 15. Door lock 15 includes, inter alia, a shaped slot 16 for receiving cylinder lock 10 and a door lock bolt hole 17 through which a bolt (not shown) is inserted to secure the cylinder lock inside a door. Typically, door lock 15 is inserted into a hollowed-out edge of the door (not shown) and cylinder lock 10 is inserted through prepared holes in the door (not shown in the figure) and perpendicularly into and through shaped slot 16, substantially along axis 18. Door lock 15 further comprises a locking tongue 19. Typically, cylinder lock 10, when unlocked, serves to translate locking tongue 19 allowing the tongue to alternately inhibit and allow opening of the door. Typically, other cylinder locks having a cross-sectional profile and length substantially matching cylinder lock 10 may be replaced or retrofitted instead of cylinder lock 10. Typical names/manufacturers of such cylinder locks include, but are not limited to: Euro Cylinders; Oval Cylinders; Asec 6-pin Euro profile; and Chubb M3. Overall lengths of such cylinders typically vary firm approximately 70-95 min.

Reference is now made to FIGS. 2A and 2B, which are cross sectional side views A-A of the cylinder lock shown in FIG. 1A. The cylinder lock has a body housing 20, which is bored from one end to the other end and a cylindrical plug 22, which is fitted into the bore, and which may be rotated as described hereinbelow. A set hole 23 is located approximately in the middle of cylinder lock 10 to receive a bolt which is inserted into door lock bolt hole 17 to secure the cylinder lock within door lock 15, as described hereinabove in FIG. 1B. Cylindrical plug 22 has a key slot 25 formed axially in cylindrical plug. Key 12 is inserted into slot 25. A pin-tumbler set 30 is located in body housing 20 and in cylindrical plug 22 to serve to lock and unlock rotational movement of cylindrical plug 22. Cylindrical plug 22 and a second cylindrical plug 31 may be mechanically coupled and uncoupled to a rotating tongue 35 by means of a selector mechanism (not shown in the figure), which allows either cylindrical plug to rotate the rotating tongue, which in turn serves to move the locking tongue of the door lock (refer to FIG. 1B). The cylinder lock shown in FIGS. 2A and 2B is called a "blind cylinder lock", meaning that a key can be inserted into only one side of the lock, with only one pin-tumbler set present on the side that accepts a key, and that the other side of lock does not accept a key.

FIG. 2B, which is a detailed view of FIG. 2A, shows in greater detail pin-tumbler set 30. Pin-tumbler set 30 includes tumbler pins 32 and driver pins 34, both of which are constrained to move generally perpendicularly to key 12. Springs 33 typically serve to preload the driver pins and the tumbler pins, displacing them towards slot 25, thereby advancing part of one or more of driver pins 34 into cylindrical plug 22 through openings in the plug (not shown in the figure) and thereby locking rotation of cylindrical plug 22 when no key is present in the slot. Typically, key 12 is formed to fit the pattern and respective lengths of tumbler pins 32. When key 12 is fully inserted into slot 25, the key presses tumbler pins 32 and driver pins 34 against springs 33, alignedly inserting driver pins 34 into body housing 20, and thereby enables rotation of the cylindrical plug. Key 12 is shown inserted with its wider edge contacting the tumbler pins. Another inserted orientation of another type of key may include its thinner edge contacting the tumbler pins. Also, one or more additional sets of collinearly arranged tumbler pins (not shown) may be present in the cylinder lock, in the case when a master key is used to lock and unlock more than one of such specially configured cylinder locks.

A number of prior art electronic or combination electrical/mechanical lock systems allow a user to open a locked cylinder in a number of ways. In U.S. Pat. No. 3,889,501 by Fort, whose disclosure is incorporated herein by reference, a combination electrical and mechanical system is described. The system includes a lock having a fixed lock cylinder and a rotatable key slug. A first solenoid is employed in the current system to drive a lock pin, which is normally extended to lock the key slug. Upon insertion of an appropriately aperture-encoded key, light sources and detectors mounted in the lock are used in concert with appropriate circuitry to operate to the first solenoid to unlock key slug. In response to an electrical power failure, a spring-loaded latch pin is extended. When the latch pin is extended, a proper mechanical key is inserted and rotated and extension of the lock pin is prevented. A proper mechanical key can then be inserted to move a plurality of spring loaded pin tumblers in the lock to enable rotation of the key slug during the electrical power failure.

Aston, in U.S. Pat. No. 5,839,305 whose disclosure is incorporated herein by reference, discloses an electrically operable cylinder lock device, which includes a body with a bore housing a rotatable barrel having a key slot. The barrel is locked in position normally by a spring-loaded bar which extends axially of the barrel and is movable radially thereof. A slot in the barrel receives the bar and cam formation in the slot and acts to lift the bar to a withdrawn position in which it can be held by an electromagnet. A plunger in the bore has a slotted end to receive the tip of the key and provides a driving connection between the key and an output cam. Another embodiment disclosed by Aston has a microswitch which interacts with an inserted key and controls the supply of electrical power.

While the prior art includes an array of combination electrical/mechanical lock systems of varying complexity, there is a need for an electronic or combination electrical/mechanical cylinder look that, taking advantage of the inherent cylinder pin tumbler mechanism, call be unlocked or unlocked without the insertion of a key, while also functioning as a conventional lock operated with a key, for example, in case of an electrical power failure.

SUMMARY OF THE INVENTION

The present invention is a combined electrical/mechanical cylinder lock that, taking advantage of the inherent pin tumbler mechanism, can be unlocked without the insertion of a key, while also functioning as a conventional lock operated with a key in case of an electrical power failure.

According to the teachings of the present invention there is provided a cylinder lock device including: a body housing having a bore having a first end and a second end, with a direction of elongation defining an axial direction for the device; a rotatable cylindrical plug in the bore, the plug having an axially extending key slot from the first end; a plurality of tumbler pins deployed at least partially within the plug and displaceable by a key to enable rotation of the plug; and an opening mechanism comprising a shaft connected to a key emulator and wherein the key emulator is translatable into the key slot from within the body housing, the key emulator shaped to match and engage the plurality of tumbler pins, and adapted to displace the plurality of tumbler pills, thereby selectively enabling rotation of the plug. Most preferably, the opening mechanism is adapted to controllably displace the plurality of tumbler pins between a first state in which the plurality of tumbler pins are aligned to enable rotation of the plug and a second state, when the key emulator is translated out of the slot, in which the plurality of tumbler pins are biased towards the key slot to provide a locked state. Preferably, the lock device further includes a rotatable tongue positionable substantially axially with and at the interior end of the plug, and has an axial engager adapted to enable the rotatable tongue to rotate with the plug when a key is inserted in the slot and rotation of the plug is enabled. Typically, the axial engager is adapted to enable the rotatable tongue to rotate with the plug when the key emulator is translated into the key slot and the plug is in the first state. Preferably, a mechanically accessible handle permanently mechanically linked to the plug at the first end, is adapted to allow insertion and removal of a key from the slot, and is further adapted to rotate the plug when the plug is freed to rotate and when no key is present in the slot. Most typically, a twist knob is permanently mechanically linked to the distal end of the shaft, the knob adapted to rotate the plug when the plug is freed to rotate and when no key is present in the slot. Preferably, the opening mechanism is at least one of: mechanically actuable, electrically actuable, and mechanically and electrically actuable.

There is also provided a method of forming a cylinder lock device comprising the steps of: forming a bore in a body housing of the cylinder lock device having a first end and a second end, the body housing having a direction of elongation defining an axial direction for the device; inserting a rotatable cylindrical plug in the bore, the plug having an axially extending key slot from the first end; configuring a plurality of tumbler pins at least partially within the plug, whereby a key displaces the tumbler pins to enable rotation of the plug; and deploying an opening mechanism comprising a shaft and a shaft key emulator, wherein the key emulator is translated into the key slot from within the body housing and is shaped to match and engage the plurality of tumbler pills and to displace the plurality of tumbler pins, thereby selectively enabling rotation of the plug.

BRIEF DESCRIPTION OF THE DRAWINGS

The invention is herein described, by way of example only, with reference to the accompanying drawings, wherein:

FIGS. 1A and 1B are representations of a prior art cylinder lock and a door lock, respectively;

FIGS. 2A and 2B are cross sectional side views of the cylinder lock shown in FIGS. 1A and 1B;

DESCRIPTION OF PREFERRED EMBODIMENTS

Figures 3A, 3B, 3C:
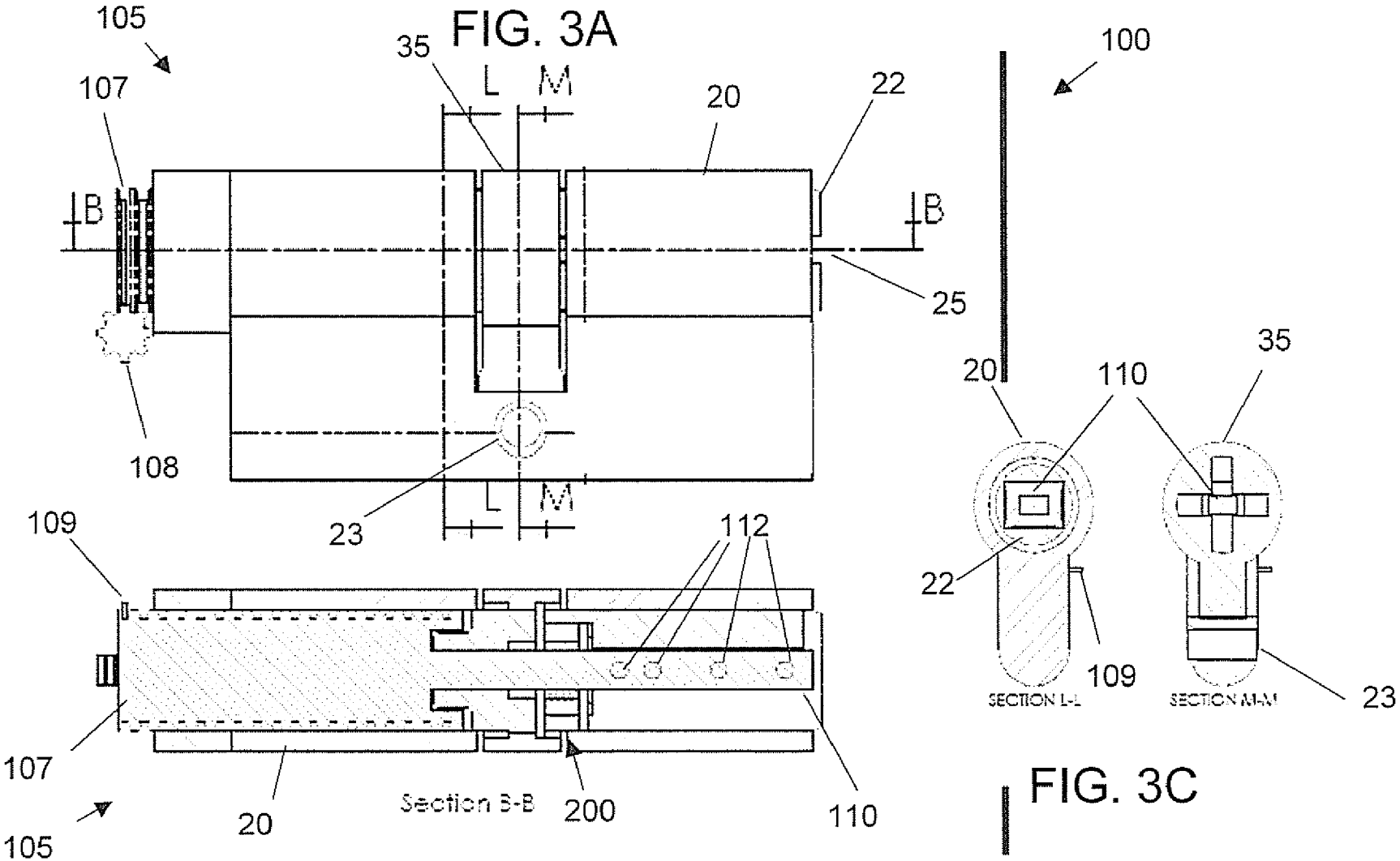
FIGS. 3A-C are side and sectional views of a cylinder lock, in accordance with of an embodiment of the present invention.

The present invention includes a lock apparatus that may be opened with or without a key.

Reference is now made to FIGS. 3A-C and 4A-C which are side and cross sectional views of cylinder lock 100, in accordance with embodiments of the present invention. Apart from differences described below, cylinder lock 100 is generally similar to cylinder lock 10 as shown in FIGS. 2A and 2B, so that elements indicated by the same reference numerals are generally identical in configuration and operation. Embodiments of the current invention disclosed hereinbelow are directed to be generally replaceable to cylinder lock 10 and/or retrofittable to cylinder lock 10 in door lock 15 shown in FIGS. 1A, 1B, 2A, and 2B.

The term "axial" and "axially", as used hereinbelow and in the claims is meant to describe a configuration generally parallel to an axis. Additionally, the terms "open"/"unlocked" and "locked", when used hereinbelow and in the claims in reference to a state of the cylinder lock, are meant to describe the respective states whereby plug rotation is enabled and disabled. The terms "blind" and "slotted", when used hereinbelow in reference to an end of the cylinder lock, are meant to describe, respectively, the ends of the cylinder lock which is blind (i.e., having no pin and tumbler set) and the end of the cylinder lock which may accept a key in the key slot (i.e., having a pin and tumbler set). In the specification and claims which follow, the term "axial engager" is intended to mean one or more variations of a clutch, clutch mechanism, or similar mechanism that serves to enable and disable rotational movement as described hereinbelow.

Cylinder lock 100 is a blind cylinder lock having a shaft opening mechanism 105, which comprises a shaft 107, to open the cylinder lock from within the lock. Shaft opening mechanism 105 is positioned generally within and at the blind end of the cylinder lock. Shaft 107 translates axially in and out of the cylinder lock, driven from the blind end of the cylinder lock. Shaft 107 has a key emulator 110, which comprises approximately one-half the length of the shaft, and which has a nearly square cross section, as shown in the figures. Typically, one lateral dimension of the key emulator is approximately equal to less than the height (i.e. the smallest dimension) of the key slot, meaning the lateral dimension is similar to that of an equivalent key. The other lateral dimension is typically less than the width an equivalent key. In certain cases, the other lateral dimension of the key emulator may be only slightly wider than the width/diameter of the pins of cylinder lock 100. The cross section and lateral dimensions of key emulator 110 allow the key emulator to pass through clutch mechanism 200 and to enter and egress the key slot. Clutch mechanism 200 is described hereinbelow.

Figure 4C:
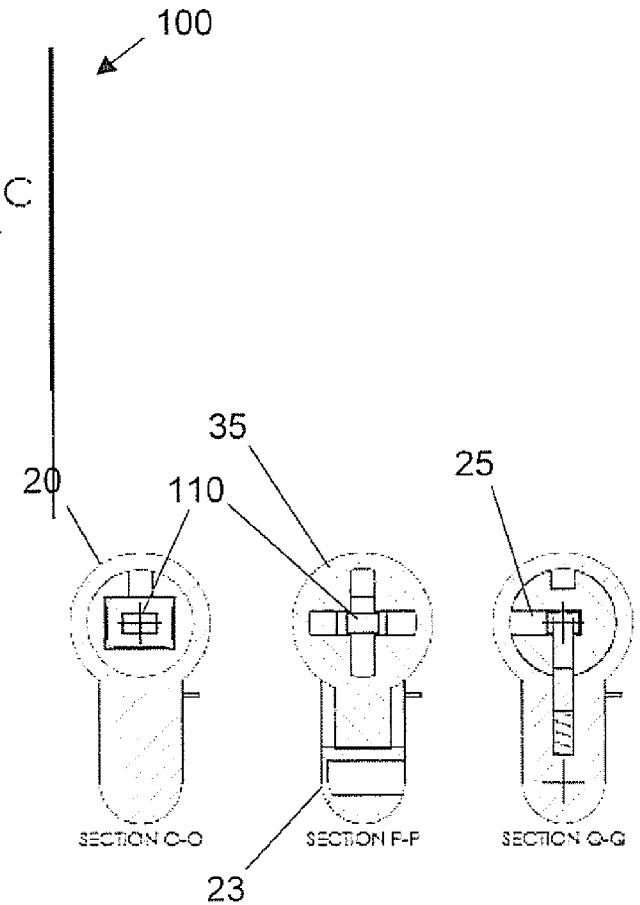
FIG. 4A-C are side and sectional views of the cylinder lock of FIG. 3.
Figure 4A:
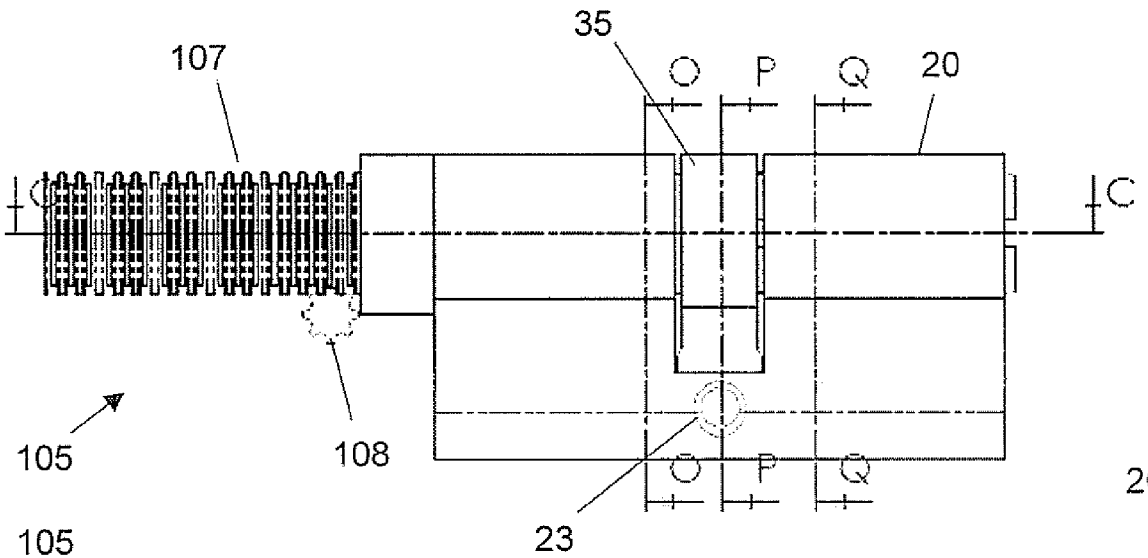
Figure 4B:
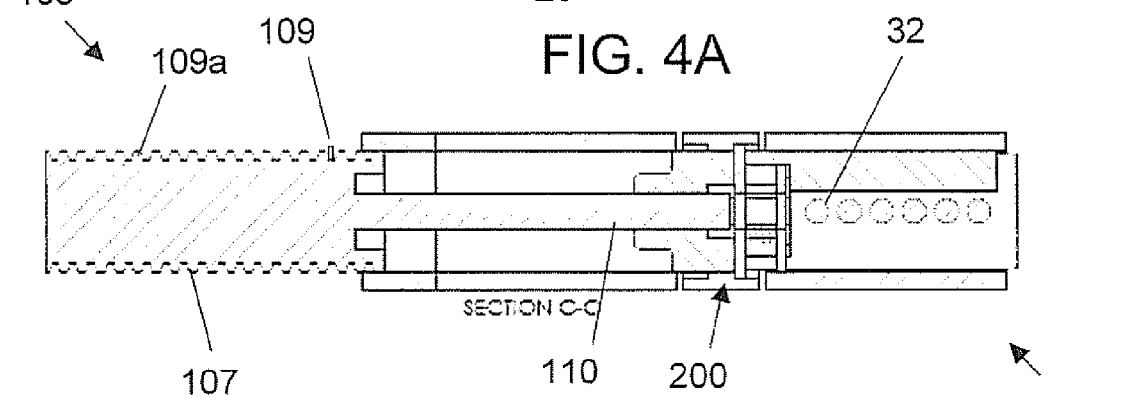

Shaft opening mechanism 105 is shown schematically in the figures in the form of a drive gear 108 and a gear shaft 109, which may be connected to a motor or to a mechanically driven linkage (not shown in the figure), or both. In 20 the embodiment where shaft 107 and key emulator 110 are formed essentially as one piece (as shown in FIGS. 3B and 4B), drive gear 108 and threads 109*a* of gear shaft 109 are matched to allow movement of drive shaft 107 only by translation axially in and out of the cylinder lock, with virtually no rotational movement of drive shaft 107.

Key emulator 110 is formed with indentations 112 which match tumbler pins 32, so that when key emulator 110 is translated completely into slot 25, it performs the same function of key 12 (as shown in FIGS. 2A and 2B) inserted from the slotted end of the cylinder lock, namely to engage tumbler pins 32, and to displace the tumbler pins, enabling rotation of the plug, as described hereinabove. When key emulator 110 is translated out of the slot, cylinder lock is locked. Shaft 107 and key emulator 110 are shown in a fully inserted position with regard to the cylinder lock in FIGS. 3A-C, whereas in FIGS. 4A-C, the shaft and the key emulator are shown fully in a fully withdrawn position with regard to the cylinder lock.

Substantially parallel indentations perpendicular to the axis of the shaft, arranged from the blind end of the shaft to the key emulator, in a form similar to threads, allow the drive gear of shaft opening mechanism 105 to drive the shaft into and out of the cylinder lock. Shaft opening mechanism 105 may be commanded by mechanical means and by wired or wireless connection to drive the shaft. Activation of shaft opening mechanism 105 as described hereinabove may be effected by direct wiring to a power and command unit outside of cylinder lock 100. Alternatively, power for the shaft opening mechanism operation may be obtained from at least one onboard battery and an activation command may be transferred through a wireless means, for example. Another example of wired and wireless activation is through a small number pad (not shown in the figure) located near cylinder lock 100. Additionally or alternatively, as noted hereinabove, shaft opening mechanism 105 may be driven by a mechanically driven linkage such as, but not limited to: a rotating knob or a lever (not shown in the current figures) so that cylinder lock 100 may be opened without electrical power, such as during a loss of electrical power.

Reference is now made to FIGS. 5A-E, which are side and sectional views and an exploded illustration of clutch mechanism 200 of the cylinder lock shown in FIGS. 3A-C and 4A-C, in accordance with an embodiment of the present invention. Clutch mechanism 200 is positioned generally coaxially with rotating tongue 35. The clutch mechanism serves to allow rotation of the rotating tongue by rotation of shaft 107 and key emulator 110, the latter which axially engages the clutch mechanism. Furthermore, the clutch mechanism enables conventional, mechanical opening of the cylinder lock and rotating the rotating tongue when key 12 is inserted into the slot, the cylinder lock is opened, and the key and plug are rotated. This mode of opening the cylinder lock is further described hereinbelow and is useful, for example, when there is a loss of electrical power to shaft opening mechanism 105, shown in FIGS. 3A-C and 4A-C.

Figures 5A, 5B, 5C, 5D, 5E:
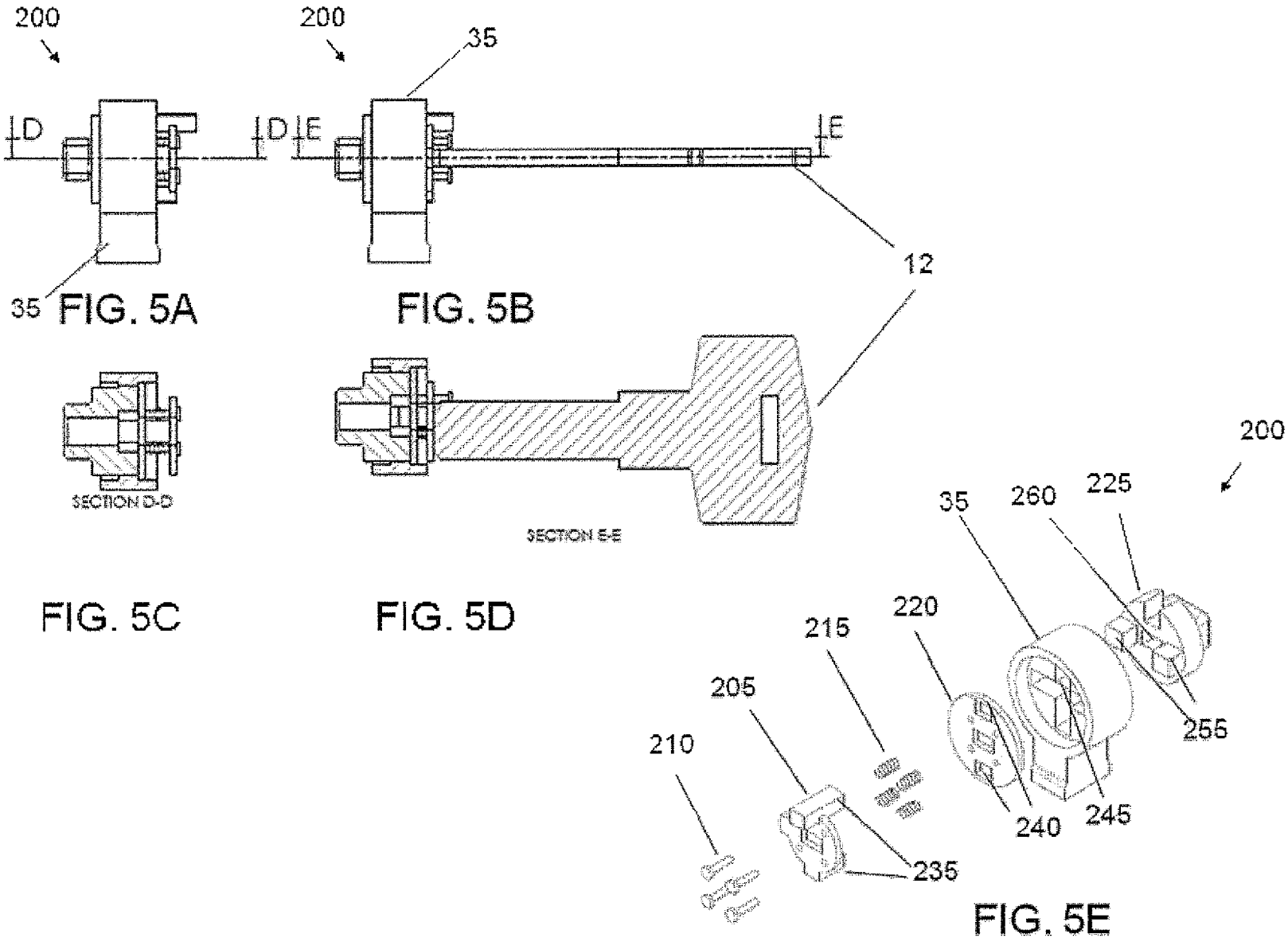
FIGS. 5A-E are side and sectional views and an exploded illustration of the clutch mechanism of the cylinder lock shown in FIGS. 3A-C and 4A-C, in accordance with an embodiment of the present invention.

Clutch mechanism 200, as shown in the exploded illustration of FIG. 5E and as viewed from the key slotted side, includes retention pins 210, which retain a pressure plate 205, biasing springs 215 (through which pins 210 pass), a retention plate 220, which fits flush within rotating tongue 35, and shaft bearing plate 225, which fits flush within a lip of the blind side of the rotating tongue. While retention plate 220 fits flush within rotating tongue 35, as previously described, relative rotational motion is possible between the retention plate and the rotating tongue. Pressure plate 205 has two extending arms 235 that typically fit into two matching slots 240 within retention plate 220, but do not extend to engage an internal cross-slot 245 formed within rotating tongue. The clutch is set so that two protruding lugs 255 of bearing plate 225 normally engage the internal cross-slot, so that the shaft and key emulator 110, the latter which passes axially through a slot 260 in the bearing plate and through internal cross-slot 245, rotate together with the rotating tongue, whether or not key 12 is present in the slot of the cylinder lock. (This functionality allows the rotating tongue to always be rotated, to open the door for example, from the blind side of the cylinder lock.) Additionally, the clutch is set so that pressure plate 205 is typically biased by biasing springs 215 away from retention plate 220 and the rotating tongue, as described previously, so that the two extending arms 235 are not engaged with the rotating tongue when no key is present in the slot of the cylinder lock. When the key is inserted into the slot, opening the lock as described hereinabove, retention of the key in the slot serves to press pressure plate 205, thereby compressing biasing springs 215, and thereby allowing arms 235 to translate and engage into internal cross slot 245. In this configuration, turning the key will presently turn the rotating tongue, allowing the door, for example, to be opened from the key side (i.e. "slotted" side) of the cylinder lock.

The embodiments described hereinabove allow for opening cylinder lock 100 from the slotted side and rotating the rotating tongue using the key, in a manner similar to that of a prior art cylinder lock, if necessary. However, when no key is present in slot 25 and shaft opening mechanism 105 is activated to open cylinder lock 100, there must be a means with which to similarly rotate the rotating tongue when operating the lock from the slotted side and from the blind side, respectively. The following discussion addresses these considerations.

Figure 6A:
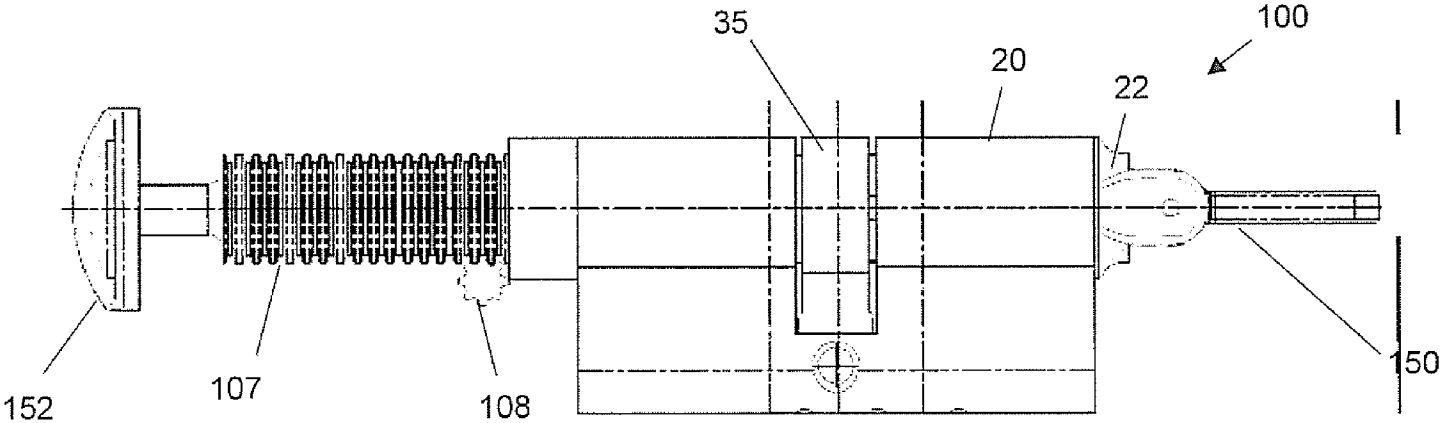
FIG. 6A-C are a side view and an isometric illustration of the cylinder lock of FIGS. 3 and 4, having plug rotational and grasping handles affixed to respective ends of the lock, and an end view of the rotational handle.
Figure 6B:
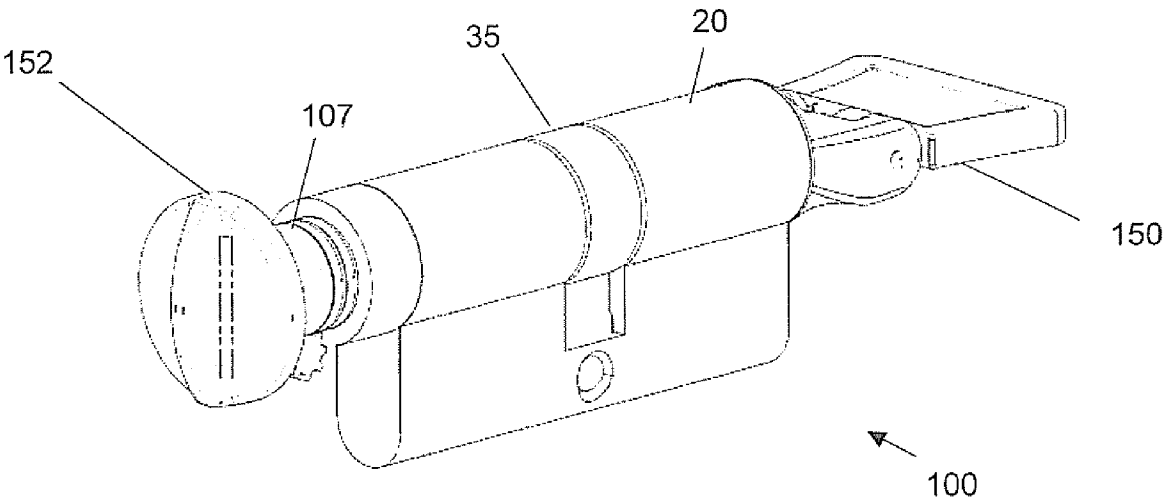
Figure 6C:
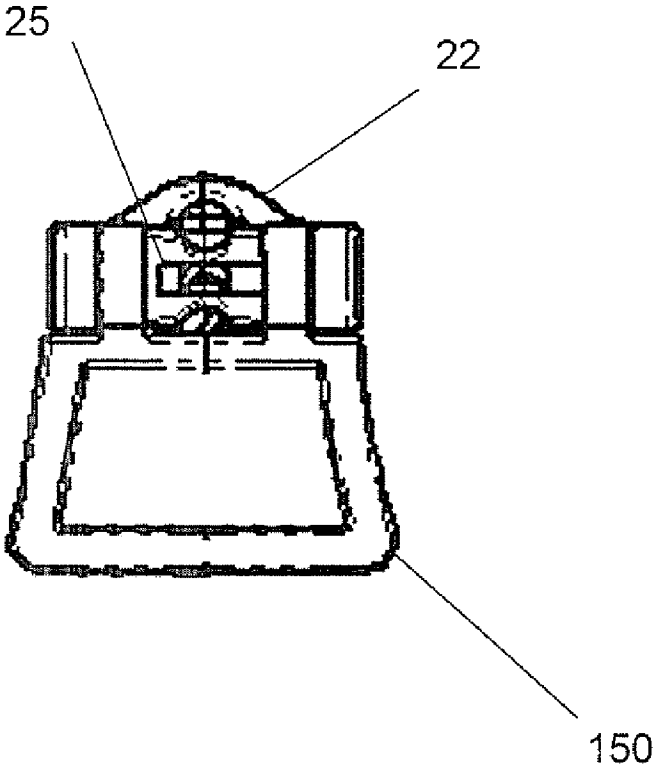

Reference is now made to FIGS. 6A-C which are a side view and an isometric illustration of cylinder lock 100 of FIGS. 3 and 4, having rotational handle 150 and grasping handle 152 affixed to the respective slotted and blind ends of the cylinder lock, and an end view of handle 150. Apart from differences described below, elements indicated by the same reference numerals are generally identical in configuration and operation. Rotational handle 150 is mechanically attached to the slotted end of cylindrical plug 22. Rotational handle 150 has a flattened wide shape and a hinge which allows rotational handle 150 to be deployed generally axially to cylinder lock 100, thereby enabling rotation of opened cylindrical plug 22, in a manner similar to that of when a key is inserted into the cylinder lock. When not in use, rotational handle 150 is stowed substantially perpendicularly to the longitudinal axis of cylinder lock 100, allowing access of a key to be inserted into key slot 25, as shown in FIG. 6C. Grasping handle 152 is fixed to the blind end of shaft 107. Grasping handle 152 has a shape which allows the handle to be grasped typically between the thumb and index finger to pull and push shaft 107 when used in the embodiment described hereinabove, wherein the shaft and the key emulator are formed as one piece. Once the key emulator is fully translated/inserted into the key slot, the grasping handle is then rotated to rotate the key emulator, which serves to rotate the rotating tongue and open the cylinder lock.

In the embodiment described hereinabove, where the shaft and the key emulator are joined with the coupling, grasping handle 152 is grasped and rotated to rotate the shaft and thereby translate the key emulator into the key slot. When the key emulator is fully translated into the key slot, such as shown in FIG. 3B, an additional clutch (not shown in the figures) is engaged and serves to disable relative rotation between shaft 107 and key emulator 110. The key emulator is presently rotated by further rotation of the grasping handle in a manner similar to that described hereinabove for another embodiment. The key emulator serves to rotate the rotating tongue and thereby open the cylinder lock.

The embodiments described hereinabove allow for operating and opening cylinder lock 100 in three possible operating states, as described below:

1. The emulator is engaged into the slot and the lock may be opened from the slotted end of the cylinder lock using the rotational handle or from the blind end of the cylinder lock using the grasping handle;
2. the emulator is completely not engaged into the slot and the lock may be opened only from slotted end of the cylinder lock using a key; and
3. a "secured mode" wherein the emulator is partially engaged in the slot, thereby inhibiting opening the cylinder lock from its slotted end and not allowing opening the cylinder from the blind end of the cylinder lock.

In the third state above, the lock may only be opened by mechanically or electrically activating the opening mechanism from blind end of the cylinder lock or by electrically activating the opening mechanism from the slotted end of the cylinder lock.

Cylinder lock 100 is typically positioned in a door, window, gate, or any configuration wherein a cylinder lock may be typically applied, so that the blind end faces the inside or generally unsecured side of the door, window, gate, etc., whereas the slotted end faces the outside or secured side. However, the cylinder lock may alternatively be positioned so that the blind side faces outside and the slotted side faces inside, depending on the application. Whereas references hereinabove have been made to a cylinder lock as typically used in a door, embodiments of the current invention are likewise applicable to any configuration herein a cylinder lock is typically applied. Such configurations may include, but are not limited to: drawers, windows, sates, gates, etc. Additionally, whereas various functions of cylinder lock 100 described hereinabove include electrical functioning, embodiments of the current invention include "fail-safe" operation by mechanical means only, such as in case of a power failure.

It will be appreciated that the above descriptions are intended only to serve as examples, and that many other embodiments are possible within the scope of the present invention as defined in the appended claims.

What is claimed is:

1. A cylinder lock device comprising:

a body housing having a bore having a first end and a second end, with a direction of elongation defining an axial direction for the device;

a rotatable cylindrical plug in the bore, the plug having an outer end, substantially aligned with the first end, and an inner end and having an axially extending key slot from the inner end to the outer end;

a plurality of tumbler pins deployed at least partially within the plug and displaceable by a key insertable from the first end to enable rotation of the plug; and an opening mechanism comprising a shaft opening mechanism adapted to drive a shaft connected to a key emulator, the key emulator permanently deployed within the body housing, and wherein the key emulator is translatable into the key slot from the inner end, the key emulator shaped to match and engage the plurality of tumbler pins, and adapted to displace the plurality of tumbler pins, such that rotation of the plug is alternately enabled by insertion of the key from the first end and by operation of the opening mechanism; and a mechanically accessible handle permanently mechanically linked to the plug at the first end is adapted to allow insertion and removal of a key from the slot and which is further adapted to rotate the plug when the plug is freed to rotate and when no key is present in the slot.

2. A lock device according to claim 1, wherein the opening mechanism is adapted to controllably displace the plurality of tumbler pins between a first state in which the plurality of tumbler pins are aligned to enable rotation of the plug and a second state, when the key emulator is translated out of the inner end of the key slot, in which the plurality of tumbler pins are biased towards the key slot to provide a locked state.

3. A lock device according to claim 1, further comprising a rotatable tongue positionable substantially coaxially with and at the inner end and having an axial engager adapted to enable the rotatable tongue to rotate with the plug when a key is inserted in the slot and rotation of the plug is enabled.

4. A lock device according to claim 3, wherein the axial engager is adapted to enable the rotatable tongue to rotate with the plug when the key emulator is translated into the key slot and the plug is in a first state in which the plurality of tumbler pins are aligned to enable rotation of the plug.

5. A lock device according claim 1, wherein a grasping handle is permanently mechanically linked to an end of the shaft substantially aligned with the second end, the grasping handle adapted to rotate the plug when the plug is freed to rotate and when no key is present in the slot.

6. A lock device according to claim 1, wherein the opening mechanism is mechanically actuable.

7. A lock device according to claim 1, wherein the opening mechanism is electrically actuable.

8. A lock device according to claim 1, wherein the opening mechanism is mechanically and electrically actuable.

9. A method of forming a cylinder lock device comprising the steps of:

forming a bore in a body housing of the cylinder lock device having a first end and a second end, the body housing having a direction of elongation defining an axial direction for the device;

inserting a rotatable cylindrical plug in the bore, the plug having an outer end, substantially aligned with the first end, and having an inner end with an axially extending key slot from the inner end to the outer end;

configuring a plurality of tumbler pins at least partially within the plug, whereby a key is inserted from the first end and displaces the tumbler pins to enable rotation of the plug;

deploying an opening mechanism comprising a shaft opening mechanism to drive a shaft connected to a key emulator, wherein the key emulator is permanently deployed within the body housing and wherein the key emulator is translated into the key slot from the inner end, the key emulator being shaped to match and engage the plurality of tumbler pins and to displace the plurality of tumbler pins, such that rotation of the plug is alternately enabled by insertion of the key from the first end and by operation of the opening mechanism; and configuring a mechanically accessible handle permanently mechanically linked to the plug at the first end, the handle adapted to allow insertion and removal of a key from the slot and which is further adapted to rotate the plug when the plug is freed to rotate and when no key is present in the slot.

* * * * *